US011587779B2

(12) United States Patent
Verenchikov

(10) Patent No.: US 11,587,779 B2
(45) Date of Patent: Feb. 21, 2023

(54) MULTI-PASS MASS SPECTROMETER WITH HIGH DUTY CYCLE

(71) Applicant: Micromass UK Limited, Wilmslow (GB)

(72) Inventor: Anatoly Verenchikov, City of Bar (ME)

(73) Assignee: Micromass UK Limited, Wilmslow (GB)

( * ) Notice: Subject to any disclaimer, the term of this patent is extended or adjusted under 35 U.S.C. 154(b) by 85 days.

(21) Appl. No.: 17/256,258

(22) PCT Filed: Jun. 28, 2019

(86) PCT No.: PCT/GB2019/051839
§ 371 (c)(1),
(2) Date: Dec. 28, 2020

(87) PCT Pub. No.: WO2020/002940
PCT Pub. Date: Jan. 2, 2020

(65) Prior Publication Data

US 2021/0134581 A1 May 6, 2021

(30) Foreign Application Priority Data

Jun. 28, 2018 (GB) ..... 1810573

(51) Int. Cl.
*H01J 49/40* (2006.01)
*H01J 49/22* (2006.01)

(52) U.S. Cl.
CPC ..... *H01J 49/401* (2013.01); *H01J 49/22* (2013.01); *H01J 49/405* (2013.01)

(58) Field of Classification Search
CPC ..... H01J 49/22; H01J 49/40; H01J 49/401; H01J 49/403; H01J 49/405; H01J 49/406
See application file for complete search history.

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

International Search Report and Written Opinion for International Application No. PCT/GB2020/050471, dated May 13, 2020, 9 pages.

(Continued)

*Primary Examiner* — David E Smith
(74) *Attorney, Agent, or Firm* — Goodwin Procter LLP

(57) ABSTRACT

A multi-pass time-of-flight mass spectrometer is disclosed having an elongated orthogonal accelerator (30). The orthogonal accelerator (30) has electrodes (31) that are transparent to the ions so that ions that are reflected or turned back towards it are able to pass through the orthogonal accelerator (30). The electrodes (31) of the orthogonal accelerator (30) may be pulsed from ground potential in order to avoid the reflected or turned ion packets being defocused. The spectrometer has a high duty cycle and/or space charge capacity of pulsed conversion.

19 Claims, 4 Drawing Sheets

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,652,427 A 7/1997 Whitehouse et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A 12/1998 Dresch
5,869,829 A 2/1999 Dresch
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.
8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov

(56) References Cited

U.S. PATENT DOCUMENTS 9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 * 10/2017 Verenchikov ..... H01J 49/0031
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0026613 A1 2/2004 Bateman et al.
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0024720 A1 2/2006 McLean et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0121130 A1 5/2009 Satoh
2009/0206250 A1 8/2009 Wollnik
2009/0250607 A1 10/2009 Staats et al.
2009/0272890 A1 11/2009 Ogawa et al.
2009/0294658 A1 12/2009 Vestal et al.
2009/0314934 A1 12/2009 Brown
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0096543 A1 4/2010 Kenny et al.
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama
2013/0048852 A1 2/2013 Verenchikov
2013/0056627 A1 3/2013 Verenchikov
2013/0068942 A1 * 3/2013 Verenchikov ..... H01J 49/40 250/282
2013/0161506 A1 6/2013 Ugarov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054454 A1 2/2014 Hoyes et al.
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0217275 A1 8/2014 Ding
2014/0239172 A1 8/2014 Makarov
2014/0246575 A1 9/2014 Langridge et al.
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 * 1/2015 Grinfeld ..... H01J 49/4245 250/281
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0144779 A1 5/2015 Verenchikov
2015/0194296 A1 7/2015 Verenchikov et al.
2015/0228467 A1 8/2015 Grinfeld et al.
2015/0270115 A1 9/2015 Furuhashi
2015/0279650 A1 10/2015 Verenchikov
2015/0294849 A1 10/2015 Makarov et al.
2015/0318156 A1 11/2015 Loyd et al.
2015/0364309 A1 12/2015 Welkie
2015/0380206 A1 12/2015 White et al.
2015/0380233 A1 12/2015 Verenchikov
2016/0005587 A1 1/2016 Verenchikov
2016/0035552 A1 2/2016 Verenchikov

(56) References Cited

U.S. PATENT DOCUMENTS

| | | | | |
|---|---|---|---|---|
| 2016/0035558 | A1 | 2/2016 | Verenchikov et al. | |
| 2016/0079052 | A1 | 3/2016 | Makarov et al. | |
| 2016/0225598 | A1 | 8/2016 | Ristroph | |
| 2016/0225602 | A1* | 8/2016 | Ristroph | H01J 49/009 |
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0084443 | A1 | 3/2017 | Willis et al. | |
| 2017/0098533 | A1 | 4/2017 | Stewart et al. | |
| 2017/0168031 | A1 | 6/2017 | Verenchikov | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0330936 | A1 | 11/2018 | Hoyes et al. | |
| 2018/0366312 | A1 | 12/2018 | Grinfeld et al. | |
| 2018/0366313 | A1 | 12/2018 | Hoyes et al. | |
| 2019/0019664 | A1 | 1/2019 | Furuhashi et al. | |
| 2019/0180998 | A1 | 6/2019 | Stewart et al. | |
| 2019/0206669 | A1 | 7/2019 | Verenchikov et al. | |
| 2019/0237318 | A1 | 8/2019 | Brown | |
| 2019/0360981 | A1 | 11/2019 | Verenchikov | |
| 2020/0083034 | A1 | 3/2020 | Verenchikov et al. | |
| 2020/0090919 | A1 | 3/2020 | Artaev | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov | |
| 2020/0243322 | A1 | 7/2020 | Stewart et al. | |
| 2020/0373142 | A1 | 11/2020 | Verenchikov | |
| 2020/0373143 | A1 | 11/2020 | Verenchikov et al. | |
| 2020/0373145 | A1 | 11/2020 | Verenchikov et al. | |

FOREIGN PATENT DOCUMENTS

| | | | |
|---|---|---|---|
| CN | 102131563 | A | 7/2011 |
| CN | 201946564 | U | 8/2011 |
| DE | 4310106 | C1 | 10/1994 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1789987 | A1 | 5/2007 |
| EP | 1901332 | A1 | 3/2008 |
| EP | 2068346 | A2 | 6/2009 |
| EP | 1665326 | B1 | 4/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2274197 | A | 7/1994 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | B2 | 3/2015 |
| JP | 2015185306 | A | 10/2015 |
| RU | 2564443 | C2 | 10/2015 |
| RU | 2015148627 | A | 5/2017 |
| SU | 198034 | | 6/1967 |
| SU | 1681340 | A1 | 9/1991 |
| SU | 1725289 | A1 | 4/1992 |
| WO | 9103071 | A1 | 3/1991 |
| WO | 1998001218 | | 1/1998 |
| WO | 1998008244 | A2 | 2/1998 |
| WO | 200077823 | A2 | 12/2000 |
| WO | 2005001878 | A2 | 1/2005 |
| WO | 2005043575 | A2 | 5/2005 |
| WO | 2006014984 | A1 | 2/2006 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012013354 | A1 | 2/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013098612 | A1 | 7/2013 |
| WO | 2013110587 | A | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A | 7/2014 |
| WO | 2014142897 | A1 | 9/2014 |
| WO | 2014152902 | A2 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | A1 | 11/2016 |

(56) References Cited

FOREIGN PATENT DOCUMENTS

| | | | |
|---|---|---|---|
| WO | 2017042665 | A1 | 3/2017 |
| WO | 2017087470 | A1 | 5/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

Search Report for GB Application No. GB1903779.5, dated Sep. 20, 2019.
Search Report for GB Application No. GB2002768.6 dated Jul. 7, 2020.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999. Abstract.
Toyoda et al., "Multi-Turn-Time-of-Flight Mass Spectometers with Electrostatic Sectors", Journal of Mass Spectrometry, 38: 1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:www.etp-ms.com/file-repository/21 [retrieved on Jul. 31, 2019].
Kaufmann, R., et al., "Sequencing of peptides in a time-of-flight mass spectrometer:evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019, 5 pages.
Combined Search and Examination Report for United Kingdom Application No. GB1901411.7 dated Jul. 31, 2019.
Extended European Search Report for EP Patent Application No. 16866997.6, dated Oct. 16, 2019.
Combined Search and Examination Report for GB 1906258.7, dated Oct. 25, 2019.
Combined Search and Examination Report for GB1906253.8, dated Oct. 30, 2019, 5 pages.
Search Report under Section 17(5) for GB1916445.8, dated Jun. 15, 2020.
International Search Report and Written Opinion for International application No. PCT/GB2020/050209, dated Apr. 28, 2020, 12 pages.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB1906258.7, dated Dec. 11, 2020, 7 pages.
Carey, D.C., "Why a second-order magnetic optical achromat works", Nucl. Instrum. Meth., 189(203):365-367 (1981).
Yavor, M., "Optics of Charged Particle Analyzers", Advances in Imaging and Electron Physics Book Series, vol. 57 (2009) Abstract.
Sakurai, T. et al., "Ion optics for time-of-flight mass spectrometers with multiple symmetry", Int J Mass Spectrom Ion Proc 63(2-3):273-287 (1985).
Wollnik, H., "Optics of Charged Particles", Acad. Press, Orlando, FL (1987) Abstract.
Wollnik, H., and Casares, A., "An energy-isochronous multi-pass time-of-flight mass spectrometer consisting of two coaxial electrostatic mirrors", Int J Mass Spectrom 227:217-222 (2003). Abstract.
O'Halloran, G.J., et al., "Determination of Chemical Species Prevalent in a Plasma Jet", Bendix Corp Report ASD-TDR-62-644, U.S. Air Force (1964). Abstract.
Examination Report for United Kingdom Application No. GB1618980.5 dated Jul. 25, 2019.
Communication pursuant to Article 94(3) EPC for Application No. 16867005.7, dated Jul. 1, 2021, 6 pages.
Collision Frequency, https://en.wikipedia.org/wiki/Collision_frequency accessed Aug. 17, 2021.
International Search Report and Written Opinion for International Application No. PCT/US2016/062174 dated Mar. 6, 2017, 8 pages.
IPRP PCT/US2016/062174 issued May 22, 2018, 6 pages.
Search Report for GB Application No. GB1520130.4 dated May 25, 2016.
International Search Report and Written Opinion for International Application No. PCT/US2016/062203 dated Mar. 6, 2017, 8 pages.
IPRP PCT/US2016/062203, issued May 22, 2018, 6 pages.
Search Report for GB Application No. GB1520134.6 dated May 26, 2016.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
IPRP for application PCT/US2016/063076, dated May 29, 2018, 7 pages.
Search Report for GB Application No. 1520540.4 dated May 24, 2016.
IPRP PCT/GB17/51981 dated Jan. 8, 2019, 7 pages.
IPRP for International application No. PCT/GB2018/051206, issued on Nov. 5, 2019, 7 pages.
International Search Report and Written Opinion for International Application No. PCT/GB2018/051206, dated Jul. 12, 2018, 9 pages.
Examination Report under Section 18(3) for Application No. GB1906258.7, dated May 5, 2021, 4 pages.
Author unknown,"Electrostatic lens ," Wikipedia, Mar. 31, 2017 (Mar. 31, 2017), XP055518392, Retrieved from the Internet:URL:

(56) References Cited

OTHER PUBLICATIONS https://en.wikipedia.org/w/index.php?title=Electrostatic_lens&oldid=773161674 [retrieved on Oct. 24, 2018].
Hussein, O.A. et al., "Study the most favorable shapes of electrostatic quadrupole doublet lenses", AIP Conference Proceedings, vol. 1815, Feb. 17, 2017 (Feb. 17, 2017), p. 110003.
Guan S., et al. "Stacked-ring electrostatic ion guide" Journal of the American Society for Mass Spectrometry, Elsevier Science Inc, 7(1):101-106 (1996). Abstract.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B. et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B. et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and Instrucmental Schemes" Institute for Analytical Instrucmentation RAS, Saint-Petersburg, (2004) Abstract.
Yavor, M. I. "Planar Multireflection Time-Of-Flight Mass Analyser with Unlimited Mass Range" Institute for Analytical Instrucmentation RAS, Saint-Petersburg, (2004) Abstract.
Khasin, Y. I. et al. "Initial Experimenatl Studies of a Planar Multireflection Time-Of-Flight Mass Spectrometer" Institute for Analytical Instrucmentation RAS, Saint-Petersburg, (2004) Abstract.
Verenchicov., A. N. et al. "Stability of Ion Motion in Periodic Electrostatic Fields" Institute for Analytical Instrucmentation RAS, Saint-Petersburg, (2004) Abstract.
Verenchicov., A. N. "The Concept of Multireflecting Mass Spectrometer for Continuous Ion Sources" Institute for Analytical Instrucmentation RAS, Saint-Petersburg, (2006) Abstract.
Verenchicov., A. N., et al. "Accurate Mass Measurements for Inerpreting Spectra of atmospheric Pressure Ionization" Institute for Analytical Instrucmentation RAS, Saint-Petersburg, (2006) Abstract.
Kozlov, B. N. et al., "Experimental Studies of Space Charge Effects in Multireflecting Time-Of-Flight Mass Spectrometes" Institute for Analytical Instrucmentation RAS, Saint-Petersburg, (2006) Abstract.
Kozlov, B. N. et al., "Multireflecting Time-Of-Flight Mass Spectrometer With an Ion Trap Source" Institute for Analytical Instrucmentation RAS, Saint-Petersburg, (2006) Abstract.
Hasin, Y. I., et al., "Planar Time-Of-Flight Multireflecting Mass Spectrometer with an Orthogonal Ion Injection Out of Continuous Ion Sources" Institute for Analytical Instrucmentation RAS, Saint-Petersburg, (2006) Abstract.
Lutvinsky Y. I. et al., "Estimation of Capacity of High Resolution Mass Spectra for Analysis of Complex Mixtures" Institute for Analytical Instrucmentation RAS, Saint-Petersburg, (2006) Abstract.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
"Reflectron—Wikipedia", Oct. 9, 2015, Retrieved from the Internet: URL:https://en.wikipedia.org/w/index.php?t itle=Reflectron&oldid=684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
Hoyes et al., "Electrostatic gimbal for correction of errors in Time of Flight mass spectrometers", Waters, 2013.
Verentchikov, A., et al., "Stable ion beam transport through periodic electrostatic structures: linear and non-linear effects", Physics Procedia, 1(1):87-97, Aug. 2008.

* cited by examiner

MULTI-PASS MASS SPECTROMETER WITH HIGH DUTY CYCLE

CROSS-REFERENCE TO RELATED APPLICATIONS

This application is a U.S. national phase filing claiming the benefit of and priority to International Patent Application No. PCT/GB2019/051839, filed Jun. 28, 2019, which claims priority from and the benefit of United Kingdom patent application No. 1810573 filed on Jun. 28, 2018. The entire contents of these applications are incorporated herein by reference.

FIELD OF THE INVENTION

The invention relates to the area of time of flight mass spectrometers, multi-reflecting and multi-turn mass spectrometers, and is particularly concerned with improved duty cycle of pulsed converters.

BACKGROUND

Time-of-flight mass spectrometers (TOF MS) are widely used in combination with continuous ion sources, like Electron Impact (EI) ion sources, Electrospray Ionisation (ESI) ion sources, Inductively Coupled Plasma (ICP) ion sources and gaseous Matrix Assisted Laser Desorption and Ionization (MALDI) ion sources. To convert an ion beam from an intrinsically continuous ion source into pulsed ion packets there are employed orthogonal accelerators (OA), radiofrequency (RF) ion guides with axial ion ejection, and RF ion traps with radial pulsed ejection.

Initially, the OA method has been introduced by Bendix corporation as described in G. J. O'Halloran et.al, Report ASD-TDR-62-644, The Bendix Corporation, Research Laboratory Division, Southfield, Mich., 1964. Dodonov et.al in SU1681340 and WO9103071 reintroduced and improved the OA injection method by using an ion mirror to compensate for multiple inherent OA aberrations. The beam propagates in the drift Z-direction through a storage gap between plate electrodes. Periodically, an electrical pulse is applied between plates. A portion of the continuous ion beam, located in the storage gap, is accelerated in an orthogonal X-direction, thus forming ribbon-shaped ion packets. Due to conservation of initial Z-velocity, the ion packets drift slowly in the Z-direction, thus traveling within the TOF MS along an inclined mean ion trajectory, get reflected by ion mirror, and finally reach a detector.

For improving duty cycle of pulsed conversion there were proposed various radio-frequency ion traps with either axial ion ejection as in U.S. Pat. Nos. 6,020,586 and 6,872,938, or radial ion ejection as in U.S. Pat. Nos. 6,545,268, 8,373,120, and 8,017,909. Ions are admitted into a radio-frequency ion guide for radial confinement with RF fields. Ions are locked axially by various types of DC plugs, get dampened in gas collisions at gas pressures of about 1 to 10 mTorr, and are ejected by pulsed electric field, either axially or radially. Radial traps reach nearly 100% duty cycle of pulsed conversion, but they are strongly affected by space charge effects. The space charge capacity of RF traps is limited by the useful trap length, which in turn is limited by the geometrical arrangement within MPTOF analyzers (described below), necessary for the ion packet to bypass the trap after the ion mirror reflection.

In the last two decades, the resolution of TOF MS has been substantially improved by using multi-pass TOFMS (MPTOF) instruments. These instruments either have ion mirrors for multiple ion reflections(i.e. a multi-reflecting TOF (MRTOF)), such as described in SU1725289, U.S. Pat. Nos. 6,107,625, 6,570,152, GB2403063, and U.S.6,717,132, or have electrostatic sectors for multiple ion turns (i.e. a multi-turn TOF (MTTOF)) such as described in U.S. Pat. Nos. 7,504,620, 7,755,036, and M. Toyoda, et.al, J. Mass Spectrom. 38 (2003) 1125, each of which is incorporated herein by reference. The term "pass" is a generalized term covering ion mirror reflections in an MRTOF and ion turns in an MTTOF. In other words, an MP-TOF covers both MRTOF and MTTOF instruments. The resolving power of an MP-TOF instrument grows with increasing numbers of passes N. However, arranging a conventional OA in an MP-TOF instrument, as in U.S. Pat. Nos. 6,717,132 and 7,504,620, limits the efficiency of pulsed conversion of the OA, elsewhere called the duty cycle. To avoid spectral overlaps, the duty cycle of an MP-TOF with an OA is limited to being $DC<1/N$ for heaviest ions, and realistically $DC<1/2N$, accounting for the rims of the OA and of the detector, and further drops as the square root of the specific ion mass $\mu=m/z$ for lighter ions (see eq.3 below).

WO2016174462 proposes increasing the OA length and duty cycle by displacing the OA from the central path of the MR-TOF analyser and arranging ion oscillations around the symmetry plane of isochronous trajectory. However, operation off the isochronous plane strongly affects the resolution and the spatial ion focusing of the MRTOF analyzer. Co-pending application WO2019/030475 proposes shifting the accelerator from the MPTOF symmetry plane and pulsed deflection of ion packets back onto the symmetry plane. However, the solution poses limits onto the admitted mass range.

SUMMARY

The present invention provides a time-of-flight mass analyser comprising: at least one ion mirror or electrostatic sector for reflecting or turning ions, respectively; an orthogonal accelerator having electrodes for receiving ions and orthogonally pulsing packets of the ions into the ion mirror or electrostatic sector such that the ions are reflected or turned, respectively, in a first dimension (x-direction) as they drift in a drift direction (z-direction); and an ion detector; wherein the electrodes of the orthogonal accelerator define slits or comprise meshes for allowing ions that have been reflected by the ion mirror, or turned by the electrostatic sector, to pass back into and through the orthogonal accelerator as they travel towards the detector.

The mass analyser is configured such that after the ions have been reflected or turned they pass back into, through and out of the orthogonal accelerator (e.g. into a first side and out of a second, opposite side of the orthogonal accelerator), without the ions hitting the electrodes of the orthogonal accelerator. As such, the orthogonal accelerator can be relatively long in the drift direction, so as to provide a relatively high duty cycle instrument, without the orthogonal accelerator blocking the path of the ions to the detector (or without having to cause the ions to advance a relatively long distance in the drift direction for each ion reflection or turn such that the ions do not impact on the orthogonal accelerator).

The drift direction (z-direction) is perpendicular to the first dimension (x-direction).

The slits described herein may be gridless slits, i.e. they do not include meshes therein.

In the embodiments in which the ions are reflected by the at least one mirror, the mean trajectory of the reflected ions may be in a plane defined by the first dimension and the drift direction (z-direction). The orthogonal accelerator and the slits are arranged in this plane such that the ions pass through the slits.

The mass analyser may be either: (i) a multi-reflecting time-of-flight mass analyser having the orthogonal accelerator arranged between two ion mirrors, and arranged and configured so that the ions are reflected multiple times between the ion mirrors and pass through the orthogonal accelerator, via the slits or meshes, multiple times as the ions travel from the orthogonal accelerator to the detector; or (ii) a multi-turn time-of-flight mass analyser having the orthogonal accelerator arranged between electrostatic sectors of a plurality of electrostatic sectors that turn the ions a plurality of times such that the ions pass through the orthogonal accelerator multiple times, via the slits or meshes, as they travel from the orthogonal accelerator to the detector.

In the embodiments in which the mass analyser is a multi-reflecting time-of-flight mass analyser, the ions may pass into a first side of the orthogonal accelerator and out of a second opposite side of the orthogonal accelerator for at least some of the times, or each and every time, that the ions pass from one mirror to another. Similarly, in the embodiments in which the mass analyser is a multi-turn time-of-flight mass analyser, the ions may pass into a first side of the orthogonal accelerator and out of a second opposite side of the orthogonal accelerator for at least some of the times, or each and every time, that the ions complete one complete turn (i.e. are turned 360 degrees by the sectors).

The electrodes of the orthogonal accelerator and their slits or meshes may extend in the drift direction (z-direction) from an upstream end of the orthogonal accelerator to a point proximate or downstream of the detector.

The electrodes of the orthogonal accelerator may define said slits; and at least one slit, or each slit, may be provided as an aperture through an electrode of the orthogonal accelerator that is elongated in the drift direction, such that electrode material completely surrounds the perimeter of the slit; and/or at least one slit, or each slit, may be defined between electrode portions that are elongated in the drift direction and spaced apart in a direction perpendicular to the first dimension and drift direction.

The electrode portions may not be joined together at one or both of their longitudinal ends (in the z-direction). For example, the electrode portions may be two spaced apart wires or rods.

The downstream ends of the orthogonal accelerator electrodes may be spaced apart from the detector, in the drift direction (z-direction); and the electrodes of the orthogonal accelerator may define said slits; wherein each slit is defined between elongated electrode portions that are not joined together at their downstream ends.

The downstream ends are downstream in the drift direction (z-direction).

For example, each slit may be defined by a c-shaped electrode that is open at one longitudinal end, or between two separate elongated electrode portions that are not joined together at both of their longitudinal ends (e.g. two spaced apart wires or rods).

Ions may be reflected by a mirror or between ion mirrors, or turned by one or more of the electrostatic sectors, such that the ions pass through the gap one or more times as they pass from the downstream end (in the z-direction) of the orthogonal accelerator to the detector.

The mass analyser may comprise: one or more voltage supply for applying one or more voltage pulse to the electrodes of the orthogonal accelerator for performing said step of orthogonally pulsing the packets of the ions; and control circuitry configured to control the one or more voltage supply so as to only apply said one or more voltage pulse to the electrodes for orthogonally pulsing a packet of ions out of the orthogonal accelerator when ions that have previously been pulsed out of the orthogonal accelerator are not passing back through the orthogonal accelerator.

The orthogonal accelerator may comprise an ion guide portion having electrodes arranged to receive ions, and one or more voltage supply configured to apply potentials to these electrodes for confining ions in at least one dimension (X- or Y-dimension) orthogonal to the drift direction.

The orthogonal accelerator may comprise: an ion guide portion having electrodes arranged to receive ions travelling along a first axis (Z-direction), including a plurality of DC electrodes spaced along the first axis; and DC voltage supplies configured to apply different DC potentials to different ones of said DC electrodes such that when ions travel through the ion guide portion along the first axis they experience an ion confining force, generated by the DC potentials, in at least one dimension (X- or Y-dimension) orthogonal to the first axis.

The mass analyser may comprise focusing electrodes that are arranged and configured to control the motion of ions along the drift direction (z-direction) so as to spatially focus or compress each of the ion packets so that it is smaller, in the drift direction, at the detector than when pulsed out of the orthogonal accelerator.

The focusing electrodes may be configured to impart ions located at different positions, in the drift direction, within the ion packet with different velocities in the drift direction so as to perform the spatial focusing or compression.

The focusing electrodes may comprise a plurality of electrodes configured to generate an electric field region through which ions travel in use that has equipotential field lines that curve and/or diverge as a function of position along the drift direction so as to focus ions in the drift direction.

The focusing electrodes may comprise a plurality of electrodes configured to control the velocities of the ions such that ions within the orthogonal accelerator when it is pulsed have velocities, in the drift direction, that decrease as a function of distance in the drift direction towards the detector.

The plurality of electrodes may comprise an ion guide or ion trap upstream of the orthogonal accelerator and one or more electrodes configured to pulse ions out of the ion guide or ion trap such that the ions arrive at the orthogonal accelerator at different times and with velocities in the drift direction that increase as a function of the time at which they arrive at the orthogonal accelerator.

The mass analyser may comprise circuitry that synchronises the pulsing of ions out of the ion guide or ion trap with the pulsing of ion packets out of the orthogonal accelerator, wherein the circuitry is configured to provide a time delay between the pulsing of ions out of the ion guide or ion trap and the pulsing of ion packets out of the orthogonal accelerator, wherein the time delay is set based on a predetermined range of mass to charge ratios of interest to be mass analysed.

The plurality of electrodes may comprise electrodes arranged within the orthogonal accelerator to generate an axial potential distribution along the drift direction that slows ions by different amounts depending on their location, in the drift direction, within the orthogonal accelerator.

The mass analyser may be configured such that the length of the orthogonal accelerator from which ions are pulsed (Lz) is longer, in the drift direction, than half of the distance (Az) that the ion packet advances for each mirror reflection or sector turn in the first dimension.

For an MRTOF mass analyser, the distance $A_Z$ may be determined along the axis that is half-way between the mirrors (i.e. half way in the x-direction). The distance $A_Z$ may be determined based on the positions of the centre (in the z-direction) of the ion packet before and after each reflection. The distance $A_Z$ may be the mean distance Az for all of the mirror reflections. Similarly, for an MTTOF mass analyser, the distance $A_Z$ may be determined along the axis that is half-way between opposing sectors (i.e. half way in the x-direction). The distance $A_Z$ may be determined based on the positions of the centre (in the z-direction) of the ion packet before and after each 180 degree turn. The distance $A_Z$ may be the mean distance Az for all of the mirror reflections.

The ratio $L_Z/A_Z$ may be selected from the group of: (i) $0.5<L_Z/A_Z<1$; (ii) $1<L_Z/A_Z<2$; (iii) 2 $L_Z/A_Z<5$; (iv) $5<L_Z/A_Z<10$; (v) $10<L_Z/A_Z<20$; and (vi) $20<L_Z/A_Z<50$; or the length of the region of the orthogonal accelerator from which ions are pulsed (Lz) may be longer, in the drift direction, than x % of the distance, in the drift direction, between the entrance to the orthogonal accelerator and the midpoint of the detector, wherein x is: ≥10, ≥15, ≥20, ≥25, ≥30, ≥35, ≥40, ≥45, or ≥50.

The present invention also provides a mass spectrometer comprising: an ion source; and a mass analyser as described herein.

The present invention also provides a method of mass spectrometry comprising: providing a mass analyser as described herein; receiving ions in said orthogonal accelerator; pulsing ions from said orthogonal accelerator into said ion mirror or sector; reflecting or turning the ions with the ion mirror or electrostatic sector, respectively, so that the ions pass back into and through the orthogonal accelerator via the slits defined by the electrodes or the meshes in the orthogonal accelerator; and receiving ions at said detector.

An improved orthogonal accelerator is proposed for multi-pass time-of-flight mass spectrometers (MPTOF). The orthogonal accelerator is elongated in the drift Z-direction and placed on the MPTOF surface of isochronous ion motion in the orthogonal Y-direction, being a symmetry plane in MRTOF. The electrodes of orthogonal accelerator are made transparent, for example using slits in all electrodes, including the push plate. As described elsewhere herein, each slit may be formed by a slot in an electrode, or between elongated electrode portions (such as between wire or rod electrode portions, or by between the electrodes on different PCBs. Less preferably, the electrodes of the orthogonal accelerator may be made transparent by using mesh electrodes through which the ions can pass. Thus, ions may pass through the switched off accelerator after at least one reflection or turn in the MPTOF analyzer. To ease the detector bypassing and to avoid spectral confusion, ion packets may be isochronously focused in the drift Z-direction onto detector, either by isochronous trans-axial or Fresnel lens and wedge, or by arranging spatial and temporal correlation within a continuous ion beam.

To retain the ion beam within a relatively long orthogonal accelerator before it is pulsed, the ion beam may be confined with an RF quadrupolar field or within a spatially alternated DC quadrupolar field.

A long orthogonal accelerator may improve the duty cycle and space charge capacity of an MPTOF by an order of magnitude, without introducing additional analyzer aberrations and need not set limits onto the admitted mass range.

The approach may be adopted for MPTOF with radially ejecting RF ion traps. RF traps are elongated for larger space charge capacity. The trap is placed on the plane of isochronous ion motion in the MPTOF and is made of electrodes with slits, so that ions may pass through the switched off trap after at least one turn or reflection. Ion packets may be spatially focused by isochronous lens to fit the detector size after multiple passes in MPTOF.

According to the one aspect of the invention, there is provided a multi-pass MPTOF (multi-reflecting or multi-turn) time-of-flight mass spectrometer comprising:

(a) an ion source, generating an ion beam along a first drift Z-direction;

(b) an orthogonal accelerator with spatial confinement means and with electrodes connected to pulsed supplies for admitting said ion beam into a storage gap, for retaining ion beam within said confinement means and for pulsed accelerating a portion of said ion beam in the second orthogonal X-direction, thus forming ion packets;

(c) isochronous means for ion packet focusing in said Z-direction towards a detector, arranged either within or immediately after said orthogonal accelerator;

(d) an electrostatic multi-pass (multi-reflecting or multi-turn) time-of-flight mass analyzer (MPTOF), built of parallel ion mirrors or electrostatic sectors, separated by a drift space and substantially elongated in the Z-direction to form an electrostatic field in an orthogonal XY-plane; said two-dimensional field provides for a field-free ion drift in the Z-direction towards a detector, and for an isochronous repetitive multi-pass ion motion within an isochronous mean ion trajectory s-surface—either symmetry s-XY plane of said ion mirrors or curved s-surface of electrostatic sectors; wherein said s-surface is aligned with the symmetry plane of said accelerator and of said z-focusing means; and (e) wherein electrodes of said orthogonal accelerator comprise slits, transparent for return ion passage after at least one reflection or turn.

Optionally, said means for ion beam spatial confinement may comprise at least one mean of the group: (i) side plates connected to radiofrequency (RF) signal; (ii) side plates connected to an attracting DC potential; (iii) segmented side plates connected to spatially alternated DC potentials; (iv) segmented DC dipoles connected to spatially alternated dipolar DC potentials.

Optionally, said isochronous means for ion packet focusing in the Z-direction may comprise at least one means of the group: (i) a set of trans-axial lens and wedges; (ii) a Freznel lens and wedge arranged in multi-segmented deflector; and (iii) means for spatial or temporal variations of ion beam energy for arranging negative correlation between energy and position in Z-direction.

Optionally, said spatial-temporal correlation may be arranged with at least one means of the group: (i) pulsed acceleration of continuous ion beam in the Z-direction either within electrostatic channel or within a radio frequency RF ion guide, located upstream of said orthogonal accelerator; (ii) a time-variable floated elevator within an electrostatic channel or an RF ion guide, located upstream of said pulsed converter; (iii) a Z-dependent deceleration of ion beam within said orthogonal accelerator.

Optionally, said drift space of said multi-pass analyzer may be set at ground and wherein electrodes of said orthogonal accelerator may be energized by pulsed voltages to extract said ion packets.

According to the another aspect of the invention, there is provided a method of time-of-flight mass spectrometry comprising the following steps:

(a) generating an ion beam along a first drift Z-direction in an ion source;

(b) admitting said ion beam into a storage gap of an orthogonal accelerator, spatially confining said ion beam within said storage gap, and pulsed accelerating a portion of said ion beam in the second orthogonal X-direction, thus forming ion packets;

(c) ion packet focusing in said Z-direction towards a detector, arranged at or immediately after said orthogonal accelerator step;

(d) in an orthogonal XY-plane, arranging two dimensional electrostatic fields of multi-pass (multi-reflecting or multi-turn) time-of-flight mass analyzer (MPTOF), substantially elongated in the Z-direction; said two-dimensional fields provide for a field-free ion drift in the Z-direction towards a detector, and for an isochronous repetitive multi-pass ion motion within an isochronous mean ion trajectory s-surface—either symmetry s-XY plane of said ion mirrors or curved s-surface of electrostatic sectors; wherein said s-surface is aligned with the symmetry plane of electric fields at said acceleration and said z-focusing steps; and (e) Wherein said fields of orthogonal accelerator are arranged with transparent electrodes for non destructing and non defocusing return ion passage after at least one reflection or turn.

Optionally, said step of ion beam spatial confinement may comprise at least one step of the group: (i) radial ion confinement by radiofrequency (RF) quadrupolar field; (ii) ion confinement in the X-direction by quadrupolar DC field; (iii) radial ion confinement within periodic DC field of annular ion guide; and (iv) radial ion confinement within quadrupolar and spatially periodic DC field.

Optionally, said step of isochronous ion packet focusing in the Z-direction may comprise at least one step of the group: (i) ion focusing in electrostatic field of trans-axial lens and wedges; (ii) ion focusing by a Freznel lens and wedge arranged in multi-segmented deflector; and (iii) arranging negative correlation between ion energy and position in Z-direction within said ion storage gap.

Optionally, said spatial-temporal correlation may be arranged with at least one step of the group: (i) pulsed acceleration of continuous ion beam in the Z-direction either within electrostatic channel or within a radio frequency RF ion guide, located upstream of said orthogonal accelerator; (ii) a time-variable floating of an elevator within an electrostatic channel or an RF ion guide, located upstream of said pulsed converter; and (iii) a Z-dependent deceleration of ion beam at said step of ion beam spatial confinement.

Optionally, said drift space of said multi-pass analyzer may be set at ground and wherein electrodes of said orthogonal accelerator may be energized by pulsed voltages to extract said ion packets.

Optionally, the ratio $L_Z/A_Z$ of said of ion packet length and of an ion advance per single pass (reflection or turn) may be one of the group: (i) $0.5<L_Z/A_Z\leq 1$; (ii) $1<L_Z/A_Z\leq 2$; (iii) $2<L_Z/A_Z\leq 5$; (iv) $5<L_Z/A_Z\leq 10$; (v) $10<L_Z/A_Z\leq 20$; and (vi) $20<L_Z/A_Z\leq 50$.

According to another aspect of the invention, there is provided a multi-pass MPTOF (multi-reflecting or multi-turn) time-of-flight mass spectrometer comprising:

(a) an ion source, generating an ion beam;

(b) a radio-frequency ion trap converter, substantially elongated in the first Z-direction and ejecting ion packets substantially along the second orthogonal X-direction;

(c) means for steering and focusing of ion packets within or immediately past said trap converter;

(d) an electrostatic multi-pass (multi-reflecting or multi-turn) time-of-flight mass analyzer (MPTOF), built of parallel ion mirrors or electrostatic sectors, separated by a drift space and substantially elongated in the Z-direction to form an electrostatic field in an orthogonal XY-plane; said two-dimensional field provides for a field-free ion drift in the Z-direction towards a detector, and for an isochronous repetitive multi-pass ion motion within an isochronous mean ion trajectory s-surface—either symmetry s-XY plane of said ion mirrors or curved s-surface of electrostatic sectors; wherein said s-surface is aligned with the symmetry plane of said pulsed converter and of said z-focusing means; and (e) wherein electrodes of said trap converter comprise slits, transparent for return ion passage after at least one reflection or turn.

Optionally, said pulsed converter may be tilted to the Z-axis for angle $\alpha/2$ and said means for Z-spatial focusing comprise means for ion ray steering, so that steering of ion trajectories at inclination angle $\alpha$ within said analyzer may be arranged isochronously.

BRIEF DESRIPTION OF DRAWINGS

Various embodiments will now be described, by way of example only, and with reference to the accompanying drawings in which:

FIG. 1 shows prior art U.S. Pat. No. 6,717,132 planar multi-reflecting TOF with gridless orthogonal pulsed accelerator OA, illustrating geometrical limits on the OA duty cycle;

FIG. 2 shows prior art U.S. Pat. No. 7,504,620 planar multi-turn TOF with OA; both analyzer geometry and laminated sectors do limit the ion packet width and the OA duty cycle;

DETAILED DESCRIPTION

Figure 1:
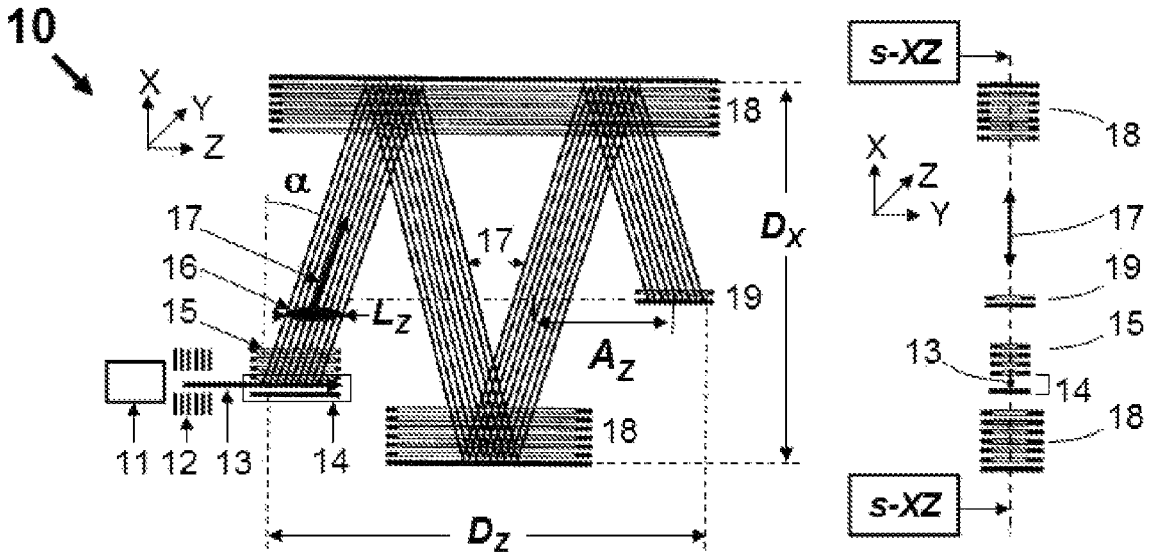
Fig.1 Prior Art

FIG. 1, shows a multi-reflecting TOF with an orthogonal accelerator (OA-MRTOF) 10 according to U.S. Pat. No.

6,717,132. The MRTOF 10 comprises: an ion source 11 with a lens system 12 to form a substantially parallel ion beam 13; an orthogonal accelerator (OA) 15 with a storage gap 14 to admit the ion beam 13; a pair of gridless ion mirrors 18 separated by a field-free drift region, and a detector 19. Both the OA 15 and mirrors 18 are formed with plate electrodes having slit openings, oriented in the Z-direction, thus forming a two dimensional electrostatic field, characterized by symmetry about the XZ-symmetry plane, denoted as s-XZ. All of the storage gap 14, the plates of the OA 15, the ion mirrors 18 and the detector 19 are aligned parallel to the drift axis Z.

In operation, ion source 11 generates ions having a range of specific masses μ=m/z.

Gaseous ion sources (like ESI, APCI, APPI, gaseous MALDI or ICP) comprise gas-filled radio-frequency (RF) ion guides (not shown) for dampening of the ion beams, followed by a lens 12 to form a substantially parallel continuous ion beam 13. Typical ion beam parameters are: lmm diameter, 1 degree angular divergence at a specific ion energy (energy per charge) $U_Z$ of from 10 to 50V at typical axial energy spread of 1 eV.

The beam 13 propagates in the Z-direction through storage gap 14, which is a field-free region between plate electrodes. Periodically, an electrical pulse is applied between the plates defining the storage gap 14. A portion of the continuous ion beam 13, in the storage gap 14, is accelerated in the X-direction by a pulsed field and is accelerated to specific energy $U_X$, thus forming a ribbon-shaped ion packet 16 travelling along the mean ion trajectory 17. Since the ion packets preserve the z-velocity of the continuous ion beam 13, the trajectories 17 are inclined at an angle α to the X-dimension, typically being several degrees, where:

$$a=(U_Z/U_X)^{0.5} \quad \text{(eq.1)}$$

Ion packets 16 are reflected by ion mirrors 18 in the X-direction, and continue to slowly drift in the Z-direction, and arrive on detector 19 after multiple N ion mirror reflections during a jigsaw shaped ion trajectory 17. To obtain higher resolving power, MRTOF analyzers are designed for longer flight paths and for larger numbers of reflections N>>1 (e.g. N=10). To avoid spectral overlaps on the detector 19 (i.e. confusion between various numbers of reflections), the useful length of each ion packet $L_Z$ becomes limited to:

$$L_Z<D_Z/N \quad \text{(eq. 2)}$$

where $D_Z$ is the distance in the Z-dimension from the most upstream point of the OA 15 that ions are ejected from to the mid-point of the detector 19 at which ions are detected.

For the realistic values of $D_Z$=300 mm and N=10, the ion packet length $L_Z$ is therefore under 30 mm. In practice, the packet length is actually about twice as small, accounting for the OA and detector rims. This in turn limits the conversion efficiency of continuous ion beam 13 into pulsed packets 16, denoted as the duty cycle DC of the orthogonal accelerator 15:

$$DC=\text{sqrt}(\mu/\mu^*)L_Z/D_Z, <\text{sqrt}(\mu/\mu^*)/2N \quad \text{(eq.3)}$$

Here μ=m/z denotes the specific mass, i.e. mass to charge ratio, and μ* defines the heaviest specific mass in the beam 13. Assuming N=10 and the smallest μ/μ*=0.01, the duty cycle for heaviest ions is under 10% and for the lightest ions in the beam is under 1% (and realistically under 0.5%). Thus, the OA-MRTOF instrument has a low duty cycle.

The duty cycle limit occurs due to the ion trajectory arrangement within the s-XZ symmetry plane of mirrors 18 and OA 15. The alignment of the ion trajectory within the s-XZ XZ plane is forced to keep the isochronous properties of the ion mirrors and gridless OA, reaching up to third order full isochronicity as described in WO2014142897. The prior art MRTOF 10 has been designed with recognition of the symmetry requirements. The duty cycle is sacrificed in exchange for higher resolving power of OA-MRTOF.

Figure 2:
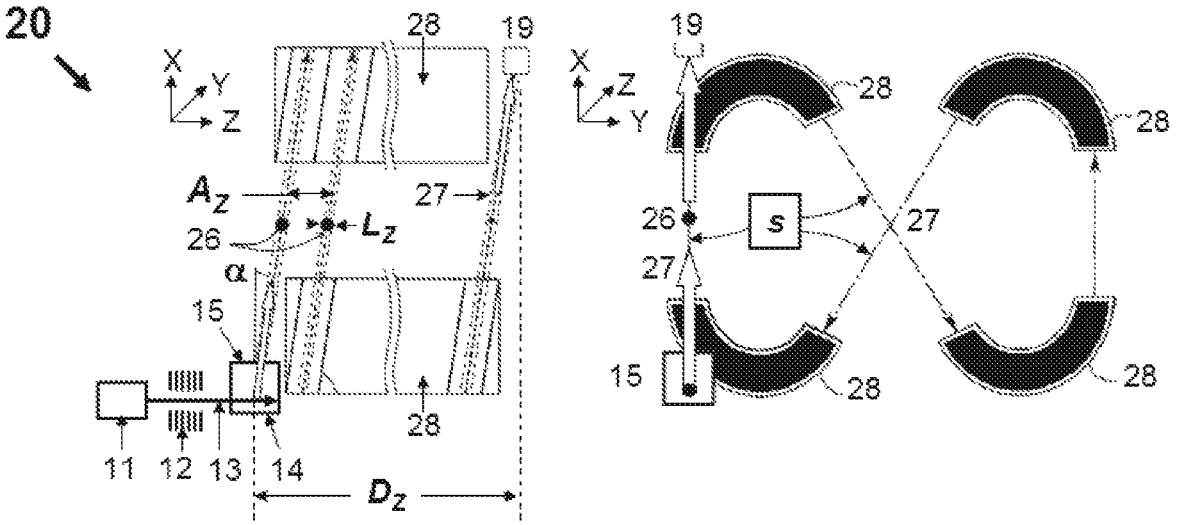
Fig.2 Prior Art

FIG. 2 shows a multi-turn TOF analyzer having an orthogonal accelerator (OA-MTTOF) 20 according to U.S. Pat. No. 7,504,620. The MTTOF 20 comprises: an ion source 11 with a lens system 12 to form a substantially parallel ion beam 13; an orthogonal accelerator (OA) 15 with a storage gap 14 to admit the beam 13; four laminated electrostatic sectors 28, separated by field-free drift regions, and a TOF detector 19.

Similarly to the instrument in FIG. 1, the OA 15 in FIG. 2 admits a slow (say, 10 eV) ion beam 13 and periodically ejects ion packets 26 along the ion trajectory 27. Electrostatic sectors 28 are arranged isochronously for a spiral ion trajectory 27 with a figure-of-eight shaped ion trajectory in the XY-plane and with a slow advancing in the drift Z-direction due to the fixed inclination angle α at which the sectors 28 are arranged. The energy of ion beam 13 and the OA acceleration voltage are arranged to match the inclination angle α of the laminated sectors.

The laminated sectors 28 provide three dimensional electrostatic fields for ion packet confinement in the drift Z-direction along the mean spiral trajectory 27. The fields of the four electrostatic sectors 28 also provide for isochronous ion oscillations along the figure-of-eight shaped central curved ion trajectory 27 in the XY-plane, also denoted as s. These sector analyzers are known to provide so-called triple focusing, i.e. first-order focusing with respect to energy spread around a mean ion energy and with respect to angular and spatial spread of ion packets around the mean ion trajectory. The sector MTTOF isochronicity has been recently improved with electrostatic sectors of non-equal radii, as described in WO2017042665.

The ion trajectory in the MTTOF 20 is locked to the fixed spiral trajectory 27 (*s*), which forces the sequential arrangement of the OA 15, sectors 28 and of the detector 19, thus limiting the duty cycle of the OA to being under 1/N, where N is the number of full turns. In addition, to arrange the spatial ion confinement within laminated sectors 28 in the Z-direction, the length $L_Z$ of ion packets 26 in the Z-dimension shall be at least twice as small as the width in the Z-dimension of each laminated channel in the sectors, and hence, the duty cycle of the MTTOF 20 is limited as described by eq.3 above. Embodiments of the present invention provide a method and apparatus for improving the duty cycle of orthogonal accelerators (OA) for multi-pass MPTOF analysers, i.e. for both multi-reflecting OA-MRTOF and multi-turn OA-MTTOF analysers.

Figure 3:
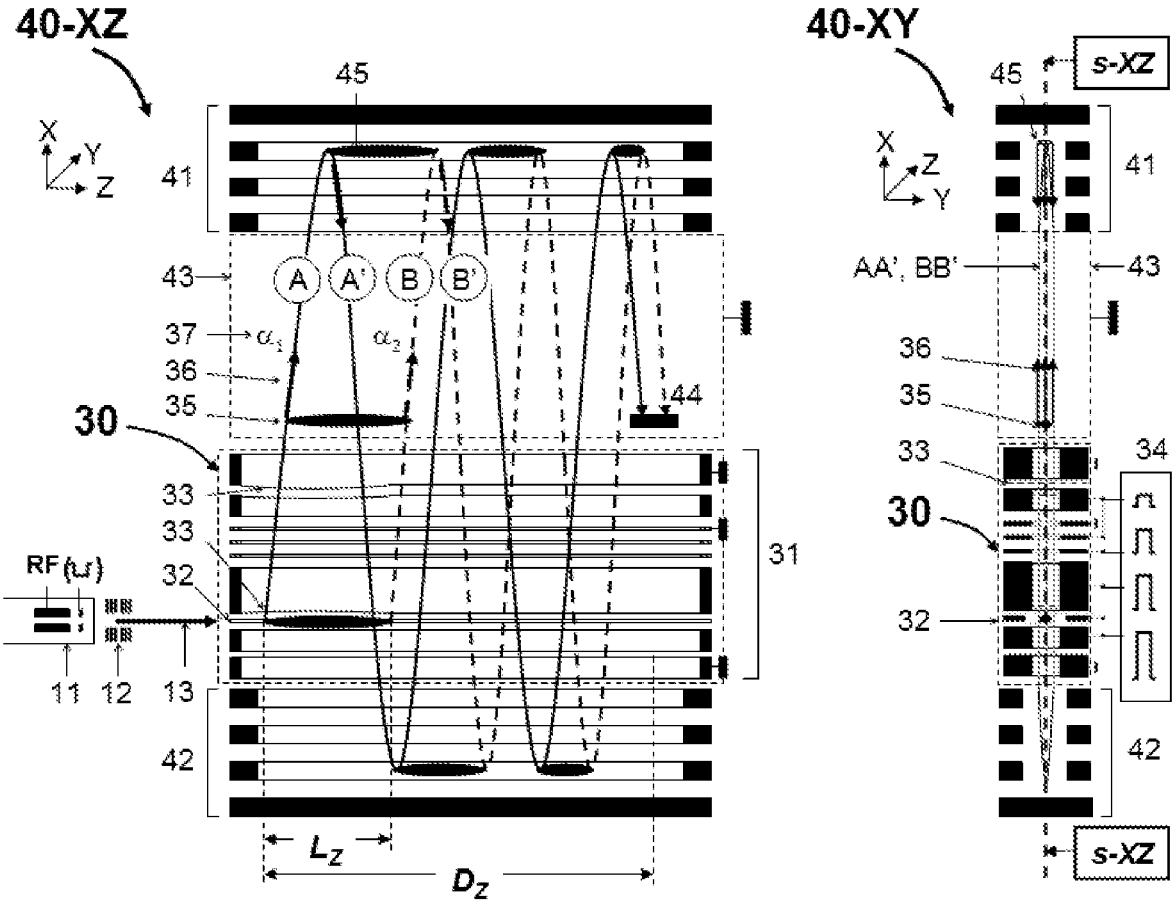
FIG. 3 shows an OA-MRTOF embodiment of the present invention, improving the duty cycle of an elongated OA by ion beam confinement, spatial z-focusing of ion packets and by making the OA transparent to reflected ions.

FIG. 3 shows an embodiment of an OA-MRTOF instrument 40 according to the present invention, in both the XZ plane (40-XZ) and the XY plane (40-XY). The instrument 40 comprises: a continuous ion source 11; a lens system 12 to form a continuous and substantially parallel ion beam 13; an orthogonal accelerator 30, composed of electrodes with elongated slits 31 (elongated in the Z-dimension) the OA 30 having means for ion beam spatial confinement 32 (detailed in FIG. 6) and an isochronous Z-focusing lens 33 which is exemplified here by a trans-axial lens formed within electrodes 31; two opposite and parallel gridless ion mirrors 4 land 42 that are separated by a grounded field-free drift space 43; and a TOF ion detector 45. The electrodes of the OA 30 and ion mirrors 41 and 42 are substantially elongated in the drift Z-direction to provide a two-dimensional electrostatic field in the X-Y plane, that is symmetric around the s-XZ symmetry plane of isochronous trajectory surface and which has a zero field component in the Z-direction.

Contrary to the prior art, the electrodes 31 of the OA 30 are made transparent for the ions being reflected back from an ion mirror 41,42. The accelerating field of the OA 30 is pulsed during ion extraction from the OA and is switched off afterwards, so that the ions reflected by the mirrors and returning through the OA are not defocussed.

In operation, a continuous or quasi-continuous ion source 11 generates ions. A substantially parallel ion beam 13 passes through ion optics 12 and enters OA 30 substantially along the Z-direction. Optionally, the beam may be spatially confined in at least the X-direction (optionally also the Y-direction) with confinement means 32 within the z-elongated storage gap of OA 30. An $L_Z$ long portion of continuous beam 13 is converted into a pulsed ion packet 35 by an orthogonal pulsed acceleration field of OA 30, energized by pulse generator 34. Ejected ion packets 35 move at some inclination angle $\alpha$ to the X-direction, which is controlled by the $U_Z$ specific energy of the incoming ion beam 13 and acceleration voltage $U_X$ gained at pulsed acceleration in the OA (see eq.1 above). Each ion packet 35 is reflected between ion mirrors 41 and 42 in the X-direction within the s-XZ symmetry plane for a large number of reflections (say, N=between 6 and 20) and while drifting in the Z-direction towards the detector 44 because the ions retain the $K_Z$ component of ion energy from the ion source 11.

Similarly to FIG. 1, the embodiment 40 employs two-dimensional Z-extended MR-TOF mirrors and an OA oriented in the Z-direction. Distinctly from FIG. 1, the duty cycle of the MRTOF 40 according to the embodiment shown is improved by the combination of the following features:

(A) To improve the duty cycle of the OA 30, the length $L_Z$ of the ion packets 35 ejected from the OA 30 may be made longer than half the distance in the Z-direction that the ion packet advances per single mirror reflection $2L_Z>A_Z=D_Z/N$. The distance $A_Z$ in the z-direction may be determined along the axis that is half-way (in the x-direction) between the mirrors, and based on the positions of the centre (in the z-direction) of the ion packet. Ultimately, the $L_Z$ length may be comparable to a notable portion (say, ½) of the total drift length $D_Z$ (e.g. where $D_Z$ is the distance in the Z-dimension from the most upstream point of the OA 30 that ions are ejected from to the mid-point of the detector 44 at which ions are detected), even if using a large number of mirror reflections. Optionally, the ratio $L_Z/A_Z$ may be one of the group: (i) $0.5<L_Z/A_Z\leq 1$; (ii) $1<L_Z/A_Z\leq 2$; (iii) $2<L_Z/A_Z\leq 5$; (iv) $5<L_Z/A_Z\leq 10$; (v) $10<L_Z/A_Z\leq 20$; and (vi) $20<L_Z/A_Z\leq 50$.

(B) Means 32 may be arranged for spatial confinement of the ion beam so as to prevent the natural expansion of ion beam 13 within the OA 30 and to allow substantial (potentially indefinite) elongation of the OA without ionic losses and without ion beam spread, as detailed below in FIG. 6.

(C) To avoid ion losses on the detector 44, so as to avoid spectral overlaps and spectral confusion (contrary to prior art open traps, described in WO2011107836), the ion packets 35 may be spatially focused in the Z-direction by a trans-axial lens 33 that may be within the OA 30 (or immediately downstream of the OA), or by a Fresnel lens, or by spatial space-velocity correlation of the continuous ion beam 13 within the OA, e.g. as described in co-pending applicationWO2019/030475. The trans-axial lens 33 may comprise focusing electrodes configured to generate an electric field region through which ions travel in use that has equipotential field lines that curve and/or diverge as a function of position along the drift Z-direction so as to focus ions in the drift Z-direction. As the result of ion packet z-focusing, the inclination angle $\alpha$ of ion trajectories with respect to the x-direction become dependent on z-position, as illustrated by ion packet vectors 36 having inclination angles $\alpha_1$ and $\alpha_2$. The spatial focusing (in the z-direction) leads to ion packet confinement towards the detector 44. The Z-focusing may be arranged isochronous, i.e. with compensation of T|Z and T|ZZ time aberrations per Z-width of ion packets, which otherwise would occur if using a conventional Einzel lens.

(D) The ion mirrors 41,42 return the long ion packets 35 towards the OA 30, as shown by trajectories A' and B'. To avoid interferences of ion rays A' and B' with the long OA 30, OA electrodes 31 are made transparent to the reflected ions, say, with elongated slits. In other words, the mass analyser is configured such that the ions pass back through the OA 30 between exiting one mirror and entering the other ion mirror (for at least some of the passes between the ion mirrors), and without the ions hitting the electrodes 31 of the OA 30. Although not shown in FIG. 3, it is contemplated that the ions may pass through the OA when travelling from the final mirror reflection to the detector 44. In order to prevent the ions hitting the OA 30, the OA electrodes 31 may comprise slits through which the ions pass as they travel between the mirrors 41,42. Each electrode 31 may comprise a single slit through which the ions pass, and that is elongated in the Z-direction. The slits (and therefore the OA electrodes) may each extend for the entire Z-width of the ion trajectories within the MRTOF analyzer. The slits may extend from the most upstream point of the OA 30 that ions are ejected from (or from further upstream) to a point in the z-direction that is proximate the position of the detector 44 (in the z-direction) such that ions do not hit the electrodes 31 when passing through the OA 30. The slits may extend to a location in the z-direction that is adjacent the upstream or downstream edge of the detector 44. The slits may be substantially coincident, in the Z-direction, with the windows of the ion mirrors 41,42. Examples of the slits are well seen in both the XZ and XY views of FIG. 3. Although FIG. 3 shows each slit as being a slotted aperture within an electrode 31 (i.e. each slit is fully surrounded by the electrode), it is contemplated that each slit may be defined between two separate electrode sections that are elongated in the Z-direction (i.e. the slit may not be bounded at one or both ends in the Z-direction). For the avoidance of doubt, the OA 30 referred to herein is the device that receives ions and pulses them orthogonally towards an ion mirror. The ion mirrors are not part of the OA 30.

To pulse each ion packet out of the OA 30, high voltage (e.g. 3 to 10 kV) pulses, produced by high voltage generators such as those built of Behlke switches, are applied to the OA electrodes 31, as shown in FIG. 3, while drift space 43 between the ion mirrors is grounded. Once the ion packet 35 is ejected from the OA 30, the potentials of the OA 30 are returned to ground (optionally except for small potentials on optional ion guide 32) before the ions are reflected back through the OA 30. The ion packets may therefore pass through the slits of the OA electrodes 31 without being defocused by the OA pulses. Each ion packet 35 may be allowed to reach the detector 44 before the next ion packet is pulsed. Alternatively, one or more further ion packets may be pulsed out of the OA before the ions in the preceding ion packet(s) have reached the detector 44. In the latter embodiment, each of these OA pulses may be times such that ions from the previous pulse(s) are not within the OA 30 at the time it is pulsed.

A numerical example for the preferred embodiment 40 is presented below, where the main parameters are as shown in the Table 1 below.

TABLE 1

| $D_X$ mm | $D_Z$ mm | $U_X$ V | $U_Z$ V | α mrad | $A_Z$ mm | N refl | L m | $L_Z$ mm | DC % |
|---|---|---|---|---|---|---|---|---|---|
| 1000 | 300 | 10000 | 10 | 30 | 30 | 10 | 10 | 150 | 50 |

In this example, the distance between the mirror caps of the mirrors in the x-direction direction is $D_X$=1 m and $D_Z$=300 mm (accounting for the useful Z-width of ion mirrors, which is not affected by 3D fringing fields at the Z-edges). The acceleration voltage for acceleration ions in the x-direction into the ion mirror is $U_X$=10 kV. By setting the ion beam specific energy to $U_Z$=10V, the average inclination angle α is set to α~30 mrad (by eq.1), i.e. the ion packet advance $A_Z$ per ion mirror reflection is $A_Z$=30 mm, and the number of ion mirror reflections is $N=D_Z/A_Z=10$ (the approximate total flight path $L=D_X*N=10$ m). If using a conventional OA-MRTOF 10, and accounting for rims of the OA and detector, the ion packet length $L_Z$ shall be limited under $D_Z/2N$=15 mm and the duty cycle for the heaviest μ mass component would be limited to under DC=1/2N=5%, as defined by equation (3). With the improvements of the embodiment 40, the ion packet length can be increased, say, to $L_Z$=150 mm, thus improving the OA duty cycle for the heaviest μ to DC=50%, i.e. by an order of magnitude.

Accounting for eq.3, the duty cycle DC of any OA instrument drops for lighter (smaller μ=m/z) ions. As an example, even if the DC=50% for an upper mass (say μ=2500), the duty cycle is still limited to DC=10% for μ=100 ions. The duty cycle for lighter ions can be further improved if using an ion guide (e.g. RF ion guide) of the ion source 11 (or between the source and OA 30) in a so-called "Pulsar" mode. Ions may be intermittently stored within the ion guide and released therefrom in a pulsed manner that is synchronized with the OA pulses, e.g. by operating an ion gate between the ion guide and OA (as indicated by pulse symbol at the exit aperture of the ion guide) such that the ions stored in the ion guide are pulsed by the OA 30. The propagation time of light ions within the OA (estimated as 50us for μ=100 at $K_Z$=10 eV and $L_Z$=150 mm) appears smaller then the time delay for extraction of heavy ions from the "Pulsar" RF ion guide, known to be about 20-30us for μ=1000 ions. Thus, using long OA 30 allows analysis of wide mass range at enhanced sensitivity.

Using a long OA 30 substantially extends the mass range able to be mass analysed to match M/m (i.e. the ratio of the heaviest mass ion to the lightest mass ion) for ions simultaneously transmitted from the RF ion guide, i.e. the Pulsar mode does not limit the mass range. Contrary to Pulsar OA-TOF instruments, the "Pulsar" gain is substantially higher for OA-MRTOF at substantially longer flight times and flight paths (say, tens and hundreds of meters). Indeed, ions may be stored in the RF ion guide between rare OA pulses, while ion packets ejected from the ion guide may be admitted into the OA with nearly unity duty cycle and a wide mass range.

Figure 4:
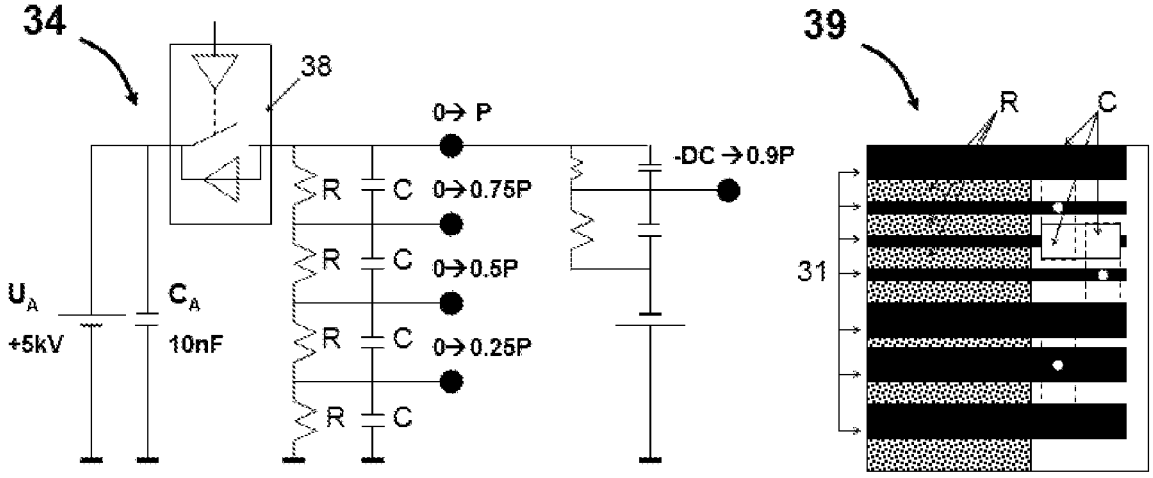
FIG. 4 shows a schematic of the electronic for pulsed ion acceleration and an example of a low capacitance OA built using ceramic printed circuit boards.

Referring to FIG. 4, an exemplary electronics pulse circuitry 34 is shown for energizing the multiple electrodes 31 and 32 of OA 30. A positive $U_A$ accelerating voltage may be buffered by a large capacitor $C_A$ (e.g. tens of nF), and may be pulse connected to an RC dividing chain via high voltage switch 38. A Behlke switch may be used, e.g. a HTS-61-05 model operating up to 6 kV, 50 A peak current and may connect a high voltage at a 40 ns rise time at capacitive loads up to a few nF. Capacitors C may be in the order of 10-100 pF to reduce the voltage sagging during the pulse. The resistors R may be in the 0.1-1MOhm range to reduce average current to well under 0.5 A, accounting for about 1% time duty cycle of pulses at a few us pulse duration and 100-300us pulse period. A clean pulse shape depends on stray capacitances and inductances. To reduce electrode capacitance and to provide short and wide connecting leads, OA 39 may be made as a ceramic PCB board with conductive strips 31, with a resistive coating in between strips, and with small and precise 10 pF size capacitors C constructed across the PCB. The combination of circuit 34 and PCB OA 39 is expected to provide clean fractions of pulse amplitude, here shown as 1, 0.75, 0.5 and 0.25 of pulse amplitude. While most OA electrodes are pulsed from ground, electrodes of the OA ion guide may be pulsed from some small (say, −10 to −30V) negative offset. The offset pulses may be arranged with a separate RC dividing chain.

Figure 5:
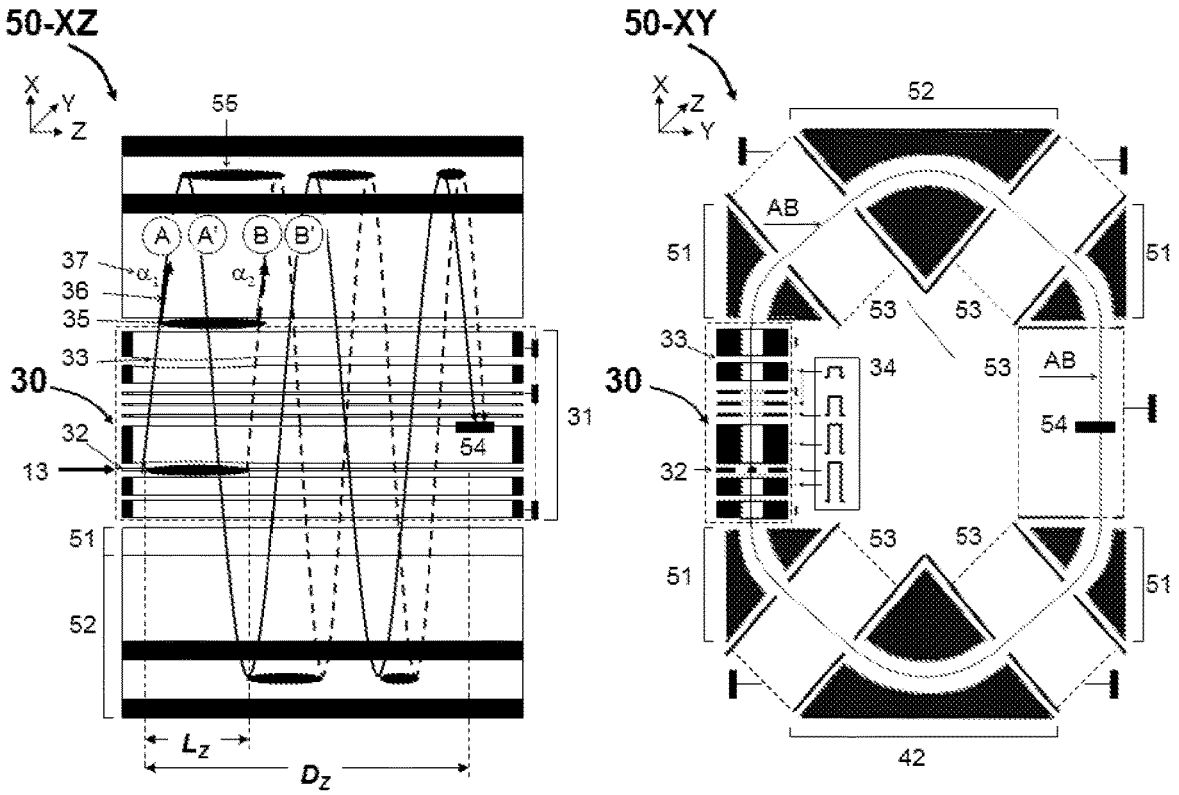
FIG. 5 shows an OA-MTTOF embodiment of the present invention, improving the duty cycle of an orthogonal pulsed converter.

FIG. 5 shows an OA-MTTOF embodiment 50 of the present invention. This is similar to the previously described embodiments, but has sectors for turning the ions rather than mirrors for reflecting the ions. FIG. 5 shows a view 50-XZ in the XZ plane and a view 50-XY in the XY plane. The analyser comprises: a (e.g. continuous) ion source to form a substantially parallel ion beam 13; a Z-elongated gridless orthogonal accelerator 30 comprising electrodes 31 with elongated slits means 32 for spatial ion confinement, and means for isochronous Z-focusing(exemplified here by a trans-axial lens 33); a set of electrostatic sectors 51 and 52, separated by drift spaces 53; and a TOF detector 54. Each of the sectors 51 and 52 may be substantially extended in the drift Z-direction (i.e. may not use lamination). This allows the ions to spiral around the device and through any given sector multiple times as the ions drift in the z-direction, as will be described below. Each sector may extend, in the z-direction, at least from the most upstream point of the OA 15 that ions are ejected from to the detector 54. The beam 13 may initially be oriented along the Z-direction.

In operation, orthogonal accelerator 30 receives (e.g. continuous) ion beam 13 within a Z-elongated storage gap, wherein means 32 may be provided to confine the ion beam at least in the X-direction (and optionally the y-direction), as detailed in FIG. 6 below. OA 30 accelerates a portion of ion beam 13 by electrical pulses from generator 34 in the X-direction, thus forming ion packets 35 (denoted 55 within the analyzer). Ion packets 35 move at some mean inclination angle α to the x-direction, controlled by the specific energy of the ion beam 13. Trans-axial lens 33 in the OA 30 (or a Fresnel lens, or some other Z-focusing means described below) may be arranged for spatial focusing of ion packets 35 in the Z-direction as they travel towards the detector 54, so that the inclination angle in the MTTOF analyzer becomes dependent on the initial z-position within ion packets. Due to the z-energy of the continuous ion beam 13, the ion packets 55 follow the spiral ion trajectory shown by rays A-B as they pass around the sectors 51,52 and within the mean trajectory surface S to provide for at least first order full isochronicity, while slowly converging in the Z-direction towards detector 54.

Optionally, sectors 51 and 52 have different radii, as described in WO2017042665 to provide for higher order isochronicity. Contrary to the prior art of FIG. 2, the sectors of the MTTOF in embodiment 50 may not have any electrostatic field component in the Z-direction, which would otherwise affect the spiral motion.

The stadium shaped ion trajectory s-surface is arranged between electrostatic sectors 51 and 52, separated by grounded field-free regions 53. The sectors XY-field and ion packet energy in the X-direction may be adjusted for isochronous ion packet motion within the trajectory surface S. The inclination angle $\alpha$ is controlled by the ion beam 13 energy and by Z-focusing means 32 only. The drift length $D_Z$ and the injection inclination angle $\alpha$ are chosen to allow for multiple (say N=10) full ion turns, before ions hit the detector 54. To improve the duty cycle of OA 30, the length $L_Z$ of the ion packets 35 may be made comparable (say ½) of the total drift length $D_Z$. At a large number of ion turns (say N=10) the ion packet length $L_Z$ appears much longer than the ion packet advance $A_Z$ per single turn.

Similarly to embodiment 40 in FIG. 3, embodiment 50 of FIG. 5 employs similar ion optical methods for: the OA elongation, ion beam confinement within the OA, Z-focusing of ion packets, making long slits in the OA electrodes, and pulsed switching off the OA potentials for return ion packet passage through the OA.

It is desired to prevent the ion beam expanding (before being pulsed) in the field free storage gap of the OA. Even with ion beam dampening in an RF ion guide upstream of the OA, the ion beam emittance is still finite (about 1 mm*deg at 10 eV), and the ion beam would naturally diverge by several mm within 100 mm along OA. This would compromise the combination of time and energy spreads of ion packets, affecting MPTOF resolution.

Figure 6:
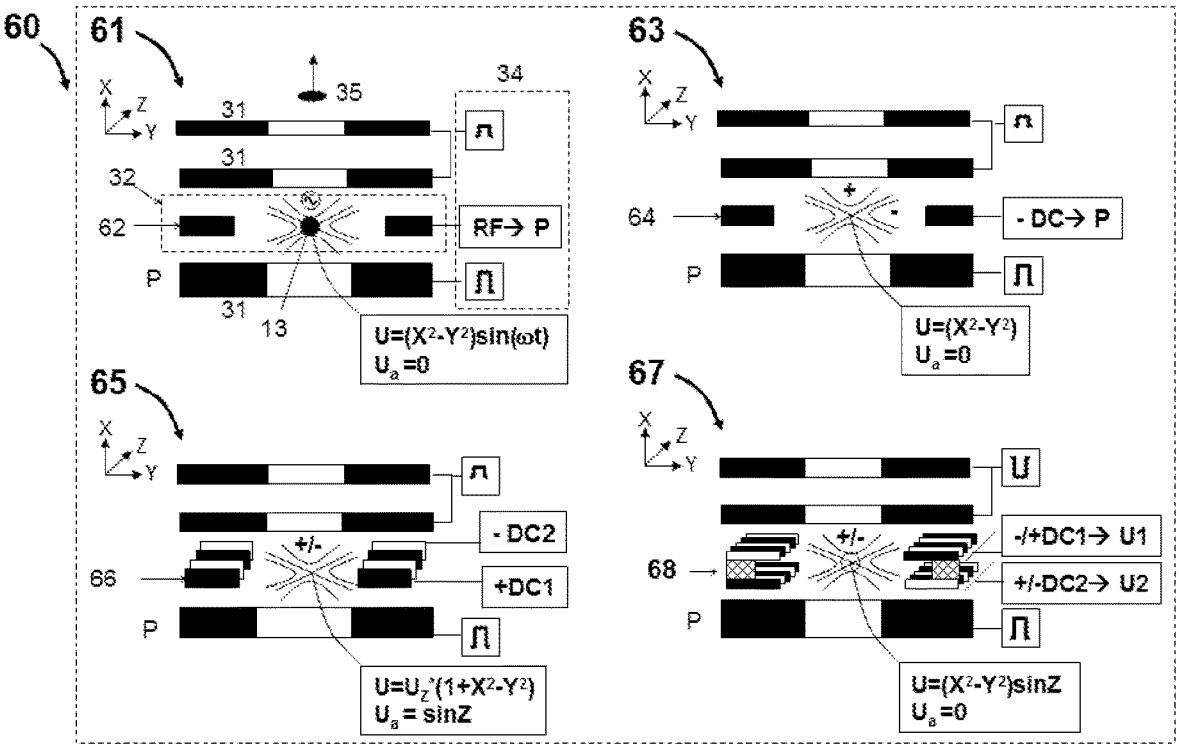
FIG. 6 illustrates various methods of ion beam spatial confinement within the storage gap of the elongated orthogonal accelerator.

Referring to FIG. 6, embodiments 61, 63, 65, and 67 present generalized means 32 for the spatial confinement of ion beam 13 within the gridless orthogonal accelerator OA 30. As described above, slit electrodes 31 of the gridless OA 30 are energized by pulse generator 34 to convert the continuous ion beam 13 into pulsed ion packets 35. The embodiments in FIG. 6 differ from each other by the applied electrical signals and by the shape of ion confining electrodes 62, 64, 66, and 68.

Embodiment 61 employs a rectilinear RF ion guide similar to U.S. Pat. No. 5,763,878. RF signals are applied to electrodes 62 so as to generate a quadrupolar RF field, radially confining ion beam 13 as it travels in the z-direction along the OA 30. Embodiment 61 has drawbacks: (i) RF confinement is mass dependent; (ii) the RF field must be turned off before the acceleration pulse within microseconds, where an RF signal decay is incomplete; (iii) pulses applied to electrodes are known to excite a resonant generator of the RF signal; and (iv) the initial ion position and initial velocity are mass and RF-phase dependent, which affect resolution, mass accuracy and angular losses in TOF analyzers.

Embodiment 63 employs a rectilinear electrostatic quadrupolar lens, formed by applying negative DC potentials to electrodes 64, as proposed in RU2013149761. A weak electrostatic quadrupolar field focuses and confines the ion beam in the critical TOF X-direction, while defocusing the ion beam in the non-critical transverse Y-direction. The method allows lossless ion beam transfer for up to $L_Z$<50 mm.

Embodiment 65 employs the spatially alternated electrostatic DC quadrupolar field along the Z-axis by alternating the polarity on DC electrodes 66, as in co-pending application WO2019/030475. The embodiment provides for indefinite ion beam confinement in both X and Y directions, although a variable central potential along the Z-axis may have a negative effect on ion beam packet focusing in the Z-direction.

Embodiment 67 provides for ion beam spatial confinement by spatial alternation of electrostatic quadrupolar field, now achieved without spatial modulation of the center-line potential U(z). The field is formed by an array of alternating DC dipoles 68, as described in co-pending application WO2019/030475. Optionally, the average potential (DC1+DC2)/2 is slightly negative to form a combination of the alternated quadrupolar field with a weak static quadrupolar field, thus providing somewhat stronger compression of the ion beam 13 in the X-direction Vs Y-direction. Relative to RF confinement 61, the electrostatic confinement 67 provides multiple advantages: (i) it is mass independent; (ii) it does not require resonant RF circuits and can be readily switched off; (iii) the strength and shape of the transverse confining field can be readily varied along the guide length; (iv) it can provide axial gradient of the guide potential without constructing complex RF circuits.

Ion packet Z-focusing may be provided as detailed in co-pending application WO2019/030475, such as by the following means:

(A) A trans-axial (TA) lens may be incorporated into the exit lens of a gridless OA (focusing in the Y-direction). For reaching isochronicity, the TA-lens may be compensated by a slight curvature of the accelerating field around the continuous ion beam. Such compensating curvature of the accelerating field may be achieved for example by TA curvature of the next extracting electrode or by an even yet slighter TA-curvature of the first push electrode. The TA-lens and the TA-compensator may be arranged for at least the Z-length of the extracted ion packet and they may be turned off by removing the pulsed OA voltages during the ion packet return passage through the OA. Optionally, the TA-lens may be combined with a TA-wedge for compensating non-intended misalignments of the OA and of the analyzer;

(B) A Fresnel lens, achieved with a multi-segmented deflector, which is energized with a gradient step voltage between thin deflecting plates may be provided. The Fresnel lens also allows arranging wedge fields with a constant bias applied to all deflecting segments, this way serving as a compensator for mechanical misalignments. The Fresnel lens may be arranged at least for the z-length of extracted ion packets and may be switched off together with the OA to allow a non-distorted return ion passage;

(C) Z-focusing may be provided by spatial-temporal correlations within a continuous ion beam, which is described below. Ion packet auto-focusing may be obtained by controlling and correlating the axial velocity $V_Z$ of the continuous ion beam with its z-position within the OA. In this case the OA does not need means for spatial Z-focusing 33.

Co-pending application WO2019/030475 describes two general methods of Z-auto-focusing, which may be used in embodiments of the present invention, and which are as follows:

(A) To focus (or compress) a range of $\mu$=m/z ions in the z-direction by the time they reach the detector, the z-directional speed of the ions may be caused to be different as a function of their z-directional position within the OA. Ions arranged within the OA at locations progressively further away from the detector (in the z-direction) may be given progressively higher z-directional speeds towards the detector such that the ion packet is compressed in the z-direction by the time that it reaches the detector. For example, one may arrange a negative correlation $V_Z(z)$ within the storage gap of the OA 30 according to $V_Z(z)/V_{Z0}=1-z/D_Z$, where $D_Z$ is the distance from beginning of the OA to the detector, $V_Z(z)$ is the axial velocity for depending on ions' z-position within the OA, $V_{Z0}=V_Z(z=0)$, where Z=0 is the beginning (upstream end) of the OA.

(B) To focus (or compress) ions in a wide mass range (e.g. for all μ), the z-dependent specific energy per charge U(z) may be caused to be different as a function of their z-directional position within the instrument. Ions arranged at locations progressively further away from the detector (in the z-direction) may be given progressively higher specific energy per charge U(z) in a direction towards the detector such that the ion packet is compressed in the z-direction by the time that it reaches the detector. For example, the z-dependent specific energy per charge U(z) may satisfy: $U(z)/U_{Z0}=(1-z/D_Z)^2$, where $U_{Z0}=U(z=0)$.

Figure 7:
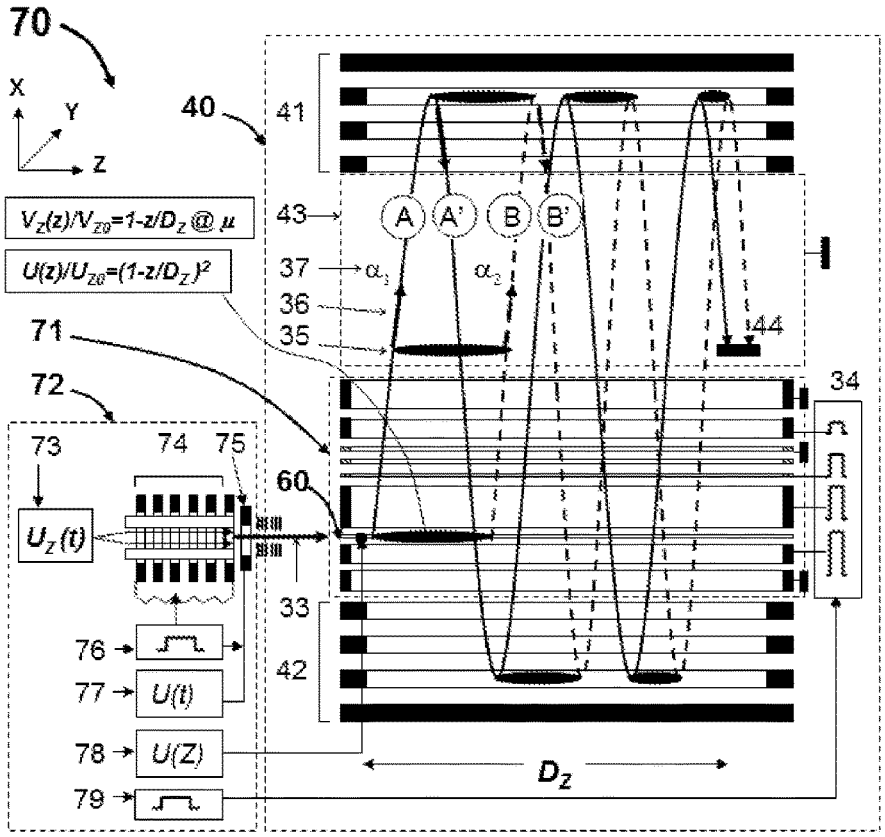
FIG. 7 illustrates an embodiment of ion packet spatial focusing in the z-direction.

Referring to FIG. 7, the embodiment 70 comprises the MRTOF 40 of FIG. 3 with an orthogonal accelerator 30, but may not have the TA-lens 33; and may have at least one beam correlating feature of the group: (i) an ion source 73 with a time variable acceleration bias $U_Z(t)$; (ii) an RF ion guide 74 with a time variable DC acceleration bias and/or with an electrode structure for switching an axial field gradient within the RF ion guide to different values; (iii) an extraction electrode 75, connected to a pulse supply 76; (iv) an extraction electrode 75, connected to a time variable power supply 77; and (v) a supply 78 for arranging a DC gradient within the ion guide 60 of the OA 30. Those beam correlating features are synchronized with pulse generator 34 of the OA 30.

In operation, substantially elongated ion beam 33 may be retained within long OA 30 by spatial confinement means 60, e.g. as described in relation to FIG. 6. Neither the OA nor MRTOF Z-focus the ions, and the orthogonal ion X-motion in the MRTOF (or MTTOF) does not affect the ion Z-motion, which is instead defined by the axial ion velocity within the OA, and hence by correlations V(z) or U(z) within continuous ion beam would control ion packet Z-autofocusing.

In one embodiment, an acceleration pulse 76 is applied to RF ion guide 74 (for example, a segmented quadrupole, or quadrupole with auxiliary electrodes, or an ion tunnel ion guide), thus forming a pulsed axial Z-field. Alternatively, a negative pulse 76 may be applied to gate 75, to follow a Pulsar method such as that described herein above. The pulse 76 amplitude and the length of axial Z-field within the guide 74 are arranged for time-of-flight compression of ion packets in the z-direction by the time the ions reach the detector 44 plane, located at distance $D_Z$. Ions located at the entrance of the axial acceleration Z-field when it is pulsed on will arrive at the OA 30 at a later time then ions located towards the exit of the axial acceleration Z-field when it is pulsed on. However, the ions that were initially located at the entrance of the axial acceleration Z-field will have a larger speed in the z-direction $V_Z$ by the time they enter the OA, as compared to ions that were initially located further from the entrance of the axial acceleration Z-field. This produces ion packet compression or bunching (in the z-direction) at the detector 44. The desired negative $Z$-$V_Z$ correlation occurs for a mass range only, where μ range is controlled by the time delay between pulse 76 and OA pulse 79. This embodiment is attractive for target analysis, where a narrow mass range is selected intentionally, while TOF data may be acquired at maximal OA frequency and dynamic range of the detector.

In another embodiment, the potential of a field-free elevator is controlled by the time variable floating U(t) 77 of either ion guide 74, or of ion optics downstream of the guide 74. The voltage at which the ion guide 74 or ion optics is floated may be varied with time so as to achieve the above described bunching effect (in the z-direction), though the elevator exit may be set closer to the OA entrance and allows a somewhat wider μ range to be accelerated by the OA.

In yet another embodiment, the beam 33 is slowed down within the confinement means 60 by arranging a Z-dependent axial potential distribution U(z) 78, e.g. by a resistive divider connected to electrodes of the confinement means 60 such that different potentials are applied at different z-locations in the confinement means 60. Then the desired z-focusing of ion packets may be achieved for the entire ionic mass range, i.e. for ions of all μ. This method is particularly attractive when using the RF ion guide in the Pulsar mode, i.e. accumulating and pulse releasing ion packets from the guide 74 in a manner that is synchronized with pulses 79 of the OA.

The OA may be a pulsed converter based on a radiofrequency (RF) ion trap with radial pulsed ejection. The space charge capacity of the trap and of the MRTOF analyzer are then improved by substantial trap elongation.

Figure 8:
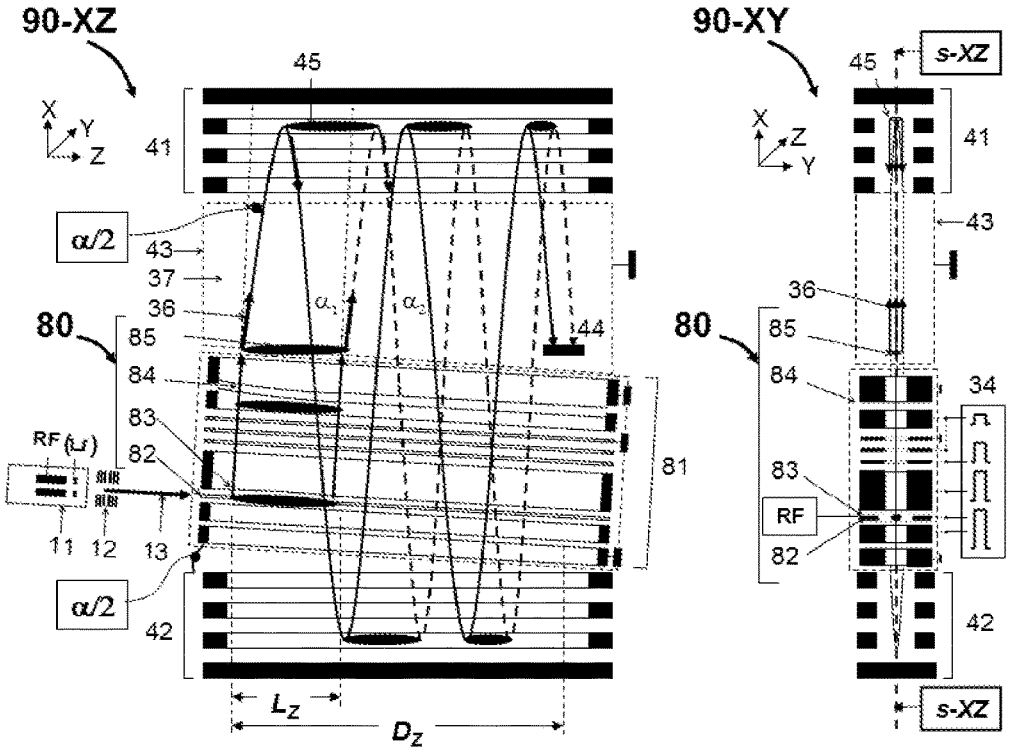
FIG. 8 shows an MRTOF embodiment of the present invention with an RF ion trap OA, improving space charge capacity of the trap by substantial trap elongation, followed by ion packets spatial focusing towards the detector.

FIG. 8 shows an OA-MRTOF embodiment 90 of the present invention that is similar to that of FIG. 3 except that the OA is a tilted ion trap 80 and the ions are introduced into the OA along a tilted axis. The embodiment 90 comprises: a continuous ion source 11 generating a continuous ion beam 13; a multi-reflecting TOF 40, similar to one in FIG. 3, and a radially ejecting (substantially in the X-direction) ion trap 80 constructed of slit electrodes 81, energized by pulsed voltages from a generator 34, and incorporating an ion guide 82 that is energized with a radio-frequency (RF) field for radial ion confinement. The electrodes of ion mirrors 41 and 42 are substantially elongated in the drift Z-direction. Trap 80 is elongated in the z-direction and is tilted to the Z axis by a small angle α/2 (say 1-2 degrees). Trap 80 may comprise a trans-axial wedge and lens 83 and a trans-axial lens 84 for ion z-focusing and for adjusting the ion steering of the mean ion trajectory by an average angle of α/2. Trap 80 is made of electrodes with slits, so it is transparent for ions at their return passage, as described above with respect to the OA.

In operation, an ion source 11 generates continuous or quasi-continuous (e.g. time-modulated within RF ion guide of the interface) ion beam 13. Beam 13 enters and get trapped within ion guide 82 by a radial confining RF field and by using electrostatic blocking potentials at one or both z-directional ends of the ion guide 82, for example, produced by a DC or pulsed bias of a segment of the ion guide 82. Ions may be trapped as a ribbon, optionally dampened with a pulsed gas admission. At the ion ejection stage, an ion ribbon is accelerated by pulsed application of voltages by the generator 34 and the ions are urged orthogonally to electrodes 81 so as to travel at an inclination angle α/2 relative to the X-axis. To correct for the tilt of the ion packet time front relative to the ion mirrors (that occurs due to the axis of the ion trap being tilted relative to the z-direction), a wedge shaped field of TA-lens 84 steers ions forward for another α/2 angle, so that ion packets 85 are parallel to the Z-direction. The wedge 84 may also have a lens component for ion packet z-focusing, whose time aberrations may be compensated for by a weaker TA-wedge 83.

After pulsed ejection and steering in the wedge field 84, ion packets 85 are aligned parallel to the Z-axis and move at an inclination angle α to the z-direction. On their way back, i.e. after the first ion mirror reflection, the ions pass through the slits of the switched off trap 80. Spatially focused (in the z-direction by lens 84) ion packets eventually reach the detector 44 after multiple mirror reflections, thus, improving MRTOF (or MTTOF in embodiments using sectors rather than mirrors) resolution.

Compared to the embodiment of the OA 30 in FIG. 3, trap 80 is capable of nearly 100% duty cycle within a wide mass range, but on the other hand may introduce several parasitic effects, such as RF phase and mass dependent parameters of ion packets, oscillations of trapping RF voltage induced by pulse pick up, and larger time and energy spreads of ion packets relative to the OA-MRT in FIG. 3. Substantial elongation of the novel (transparent) trap converter notably improves space charge capacity of the trap and of the MPTOF analyzer.

Although the present invention has been describing with reference to preferred embodiments, it will be apparent to those skilled in the art that various modifications in form and detail may be made without departing from the scope of the present invention as set forth in the accompanying claims.

For example, although embodiments have been described in which the mass analyser is an MRTOF or a MTTOF, it is contemplated that the mass analyser may instead only have a single ion mirror or sector that reflects or turns the ions, respectively, onto the detector.

Although the OA electrodes in the specific embodiments have been described as being transparent to the ions by providing them with slits, it is contemplated that the electrodes may instead be provided as mesh electrodes or with mesh portions through which the ions pass.

In the depicted embodiments, the OA electrodes and their slits extend in the drift direction (z-direction) from an upstream end of the orthogonal accelerator to a point proximate or downstream of the detector. However, it is contemplated herein that the OA electrodes and their slits (or meshes) may not extend, in the drift direction (z-direction), all of the way to the detector. Rather, there may be a gap, in the drift direction (z-direction), between the downstream end of the OA electrodes and the detector. In such embodiments, it is preferred that each slit is defined between separate elongated electrode portions (separated in the y-direction) rather than a slot in an electrode.

The invention claimed is:

1. A time-of-flight mass analyser comprising:

at least one ion mirror or electrostatic sector for reflecting or turning ions, respectively;

an orthogonal accelerator having electrodes for receiving ions and orthogonally pulsing packets of the ions into the ion mirror or electrostatic sector such that the ions are reflected or turned, respectively, in a first dimension (x-direction) as they drift in a drift direction (z-direction); and an ion detector;

wherein the electrodes of the orthogonal accelerator define slits or comprise meshes for allowing ions that have been reflected by the ion mirror, or turned by the electrostatic sector, to pass back into and through the orthogonal accelerator as they travel towards the detector;

wherein the time-of-flight mass analyser is configured to determine the mass to charge ratio of an ion based on its time-of-flight from the orthogonal accelerator to the ion detector.

2. The mass analyser of claim 1, wherein either:

(i) the mass analyser is a multi-reflecting time-of-flight mass analyser having the orthogonal accelerator arranged between two ion mirrors, and arranged and configured so that the ions are reflected multiple times between the ion mirrors and pass through the orthogonal accelerator, via the slits or meshes, multiple times as the ions travel from the orthogonal accelerator to the detector; or (ii) wherein the mass analyser is a multi-turn time-of-flight mass analyser having the orthogonal accelerator arranged between electrostatic sectors of a plurality of electrostatic sectors that turn the ions a plurality of times such that the ions pass through the orthogonal accelerator multiple times, via the slits or meshes, as they travel from the orthogonal accelerator to the detector.

3. The mass analyser of claim 1, wherein the electrodes of the orthogonal accelerator and their slits or meshes extend in the drift direction (z-direction) from an upstream end of the orthogonal accelerator to a point proximate or downstream of the detector.

4. The mass analyser of claim 1, wherein the electrodes of the orthogonal accelerator define said slits; and wherein at least one slit, or each slit, is provided as an aperture through an electrode of the orthogonal accelerator that is elongated in the drift direction, such that electrode material completely surrounds the perimeter of the slit; and/or wherein at least one slit, or each slit, is defined between electrode portions that are elongated in the drift direction and spaced apart in a direction perpendicular to the first dimension and drift direction.

5. The mass analyser of claim 1, wherein the downstream ends of the orthogonal accelerator electrodes are spaced apart from the detector, in the drift direction (z-direction); wherein the electrodes of the orthogonal accelerator define said slits; and wherein each slit is defined between elongated electrode portions that are not joined together at their downstream ends.

6. The mass analyser of claim 1, comprising: one or more voltage supply for applying one or more voltage pulse to the electrodes of the orthogonal accelerator for performing said step of orthogonally pulsing the packets of the ions; and control circuitry configured to control the one or more voltage supply so as to only apply said one or more voltage pulse to the electrodes for orthogonally pulsing a packet of ions out of the orthogonal accelerator when ions that have previously been pulsed out of the orthogonal accelerator are not passing back through the orthogonal accelerator.

7. The mass analyser of claim 1, wherein the orthogonal accelerator comprises an ion guide portion having electrodes arranged to receive ions, and one or more voltage supply configured to apply potentials to these electrodes for confining ions in at least one dimension (X- or Y-dimension) orthogonal to the drift direction.

8. The mass analyser of claim 1, wherein the orthogonal accelerator comprises: an ion guide portion having electrodes arranged to receive ions travelling along a first axis (Z-direction), including a plurality of DC electrodes spaced along the first axis; and DC voltage supplies configured to apply different DC potentials to different ones of said DC electrodes such that when ions travel through the ion guide portion along the first axis they experience an ion confining force, generated by the DC potentials, in at least one dimension (X- or Y-dimension) orthogonal to the first axis.

9. The mass analyser of claim 1, comprising focusing electrodes that are arranged and configured to control the motion of ions along the drift direction (z-direction) so as to spatially focus or compress each of the ion packets so that it is smaller, in the drift direction, at the detector than when pulsed out of the orthogonal accelerator.

10. The mass analyser of claim 9, wherein the focusing electrodes are configured to impart ions located at different positions, in the drift direction, within the ion packet with different velocities in the drift direction so as to perform the spatial focusing or compression.

11. The mass analyser of claim 9, wherein the focusing electrodes comprise a plurality of electrodes configured to generate an electric field region through which ions travel in use that has equipotential field lines that curve and/or diverge as a function of position along the drift direction so as to focus ions in the drift direction.

12. The mass analyser of claim 9, wherein the focusing electrodes comprise a plurality of electrodes configured to control the velocities of the ions such that ions within the orthogonal accelerator when it is pulsed have velocities, in the drift direction, that decrease as a function of distance in the drift direction towards the detector.

13. The mass analyser of claim 12, wherein the plurality of electrodes comprise an ion guide or ion trap upstream of the orthogonal accelerator and one or more electrodes configured to pulse ions out of the ion guide or ion trap such that the ions arrive at the orthogonal accelerator at different times and with velocities in the drift direction that increase as a function of the time at which they arrive at the orthogonal accelerator.

14. The mass analyser of claim 13, comprising circuitry that synchronises the pulsing of ions out of the ion guide or ion trap with the pulsing of ion packets out of the orthogonal accelerator, wherein the circuitry is configured to provide a time delay between the pulsing of ions out of the ion guide or ion trap and the pulsing of ion packets out of the orthogonal accelerator, wherein the time delay is set based on a predetermined range of mass to charge ratios of interest to be mass analysed.

15. The mass analyser of claim 12, wherein the plurality of electrodes comprise electrodes arranged within the orthogonal accelerator to generate an axial potential distribution along the drift direction that slows ions by different amounts depending on their location, in the drift direction, within the orthogonal accelerator.

16. The mass analyser of claim 1, configured such that the length of the orthogonal accelerator from which ions are pulsed (Lz) is longer, in the drift direction, than half of the distance (Az) that the ion packet advances for each mirror reflection or sector turn in the first dimension.

17. A method of mass spectrometry comprising:

providing a mass analyser as claimed in claim 1;

receiving ions in said orthogonal accelerator;

pulsing ions from said orthogonal accelerator into said ion mirror or sector;

reflecting or turning the ions with the ion mirror or electrostatic sector, respectively, so that the ions pass back into and through the orthogonal accelerator via the slits defined by the electrodes or the meshes in the orthogonal accelerator; and receiving ions at said detector.

18. A multi-pass time-of-flight mass spectrometer comprising:

(a) an ion source, generating an ion beam along a first drift Z-direction;

(b) an orthogonal accelerator with spatial confinement means and with electrodes connected to pulsed supplies for admitting said ion beam into a storage gap, for retaining ion beam within said confinement means and for pulsed accelerating a portion of said ion beam in the second orthogonal X-direction, thus forming ion packets;

(c) isochronous means for ion packet focusing in said Z-direction towards a detector, arranged either within or immediately after said orthogonal accelerator;

(d) an electrostatic multi-pass (multi-reflecting or multi-turn) time-of-flight mass analyzer (MPTOF), built of parallel ion mirrors or electrostatic sectors, separated by a drift space and substantially elongated in the Z-direction to form an electrostatic field in an orthogonal XY-plane; said two-dimensional field provides for a field-free ion drift in the Z-direction towards a detector, and for an isochronous repetitive multi-pass ion motion within an isochronous mean ion trajectory s-surface—either symmetry s-XY plane of said ion mirrors or curved s-surface of electrostatic sectors; wherein said s-surface is aligned with the symmetry plane of said accelerator and of said z-focusing means; and (e) wherein electrodes of said orthogonal accelerator comprise slits, transparent for return ion passage after at least one reflection or turn.

19. A multi-pass MPTOF (multi-reflecting or multi-turn) time-of-flight mass spectrometer comprising:

(a) an ion source, generating an ion beam;

(b) a radio-frequency ion trap converter, substantially elongated in the first Z-direction and ejecting ion packets substantially along the second orthogonal X-direction;

(c) means for steering and focusing of ion packets within or immediately past said trap converter;

(d) an electrostatic multi-pass (multi-reflecting or multi-turn) time-of-flight mass analyzer (MPTOF), built of parallel ion mirrors or electrostatic sectors, separated by a drift space and substantially elongated in the Z-direction to form an electrostatic field in an orthogonal XY-plane; said two-dimensional field provides for a field-free ion drift in the Z-direction towards a detector, and for an isochronous repetitive multi-pass ion motion within an isochronous mean ion trajectory s-surface—either symmetry s-XY plane of said ion mirrors or curved s-surface of electrostatic sectors; wherein said s-surface is aligned with the symmetry plane of said pulsed converter and of said z-focusing means; and (e) wherein electrodes of said trap converter comprise slits, transparent for return ion passage after at least one reflection or turn.

* * * * *